US007156929B2

(12) United States Patent
Menk

(10) Patent No.: US 7,156,929 B2
(45) Date of Patent: Jan. 2, 2007

(54) CAST IRON ALLOY

(75) Inventor: Werner Menk, Schaffhausen (CH)

(73) Assignee: Georg Fischer Fahrzeugtechnik AG, Schaffhausen (CH)

( * ) Notice: Subject to any disclaimer, the term of this patent is extended or adjusted under 35 U.S.C. 154(b) by 0 days.

(21) Appl. No.: 10/619,712

(22) Filed: Jul. 14, 2003

(65) Prior Publication Data

US 2004/0018111 A1 Jan. 29, 2004

(30) Foreign Application Priority Data

Jul. 24, 2002 (DE) ..... 102 33 732

(51) Int. Cl.
*C22C 37/04* (2006.01)

(52) U.S. Cl. ..... 148/321; 420/27; 420/32

(58) Field of Classification Search ..... 420/27, 420/28, 999, 117, 32; 148/321, 324
See application file for complete search history.

(56) References Cited

U.S. PATENT DOCUMENTS 3,657,878 A * 4/1972 Kaufmann, Jr. ..... 60/308
3,835,598 A * 9/1974 Tobey ..... 451/528
5,236,660 A 8/1993 Reynaud et al.
5,489,345 A * 2/1996 Koike et al. ..... 148/325
5,530,213 A * 6/1996 Hartsock et al. ..... 181/240
5,784,882 A 7/1998 Bonny et al.

FOREIGN PATENT DOCUMENTS

| | | |
|---|---|---|
| DE | 29 15 217 | 3/1987 |
| DE | 42 22 104 | 1/1994 |
| GB | 1 482 724 | 8/1977 |

* cited by examiner

*Primary Examiner*—George Wyszomierski
(74) *Attorney, Agent, or Firm*—Bachman & LaPointe, P.C.

(57) ABSTRACT

The invention proposes a cast iron alloy for cast iron products which are highly thermally stable, the alloy containing, as nonferrous constituents, at least the elements C, Si, Mo, Al and, as admixtures, Ni, Mg and/or S, and the C content being less than 2.9% by weight. The alloy is used, for example, to produce exhaust manifolds or turbocharger casings.

9 Claims, No Drawings

CAST IRON ALLOY

BACKGROUND OF THE INVENTION

The invention relates to a cast iron alloy for cast iron products with a high thermal stability, the alloy containing, as nonferrous constituents, at least the elements C, Si, Mo, Al and, as admixtures, Ni, Mg and/or S.

In the automotive industry, cast iron alloys are used to produce castings which have to be highly thermally stable, for example the parts which come into contact with the hot exhaust gases from the internal combustion engine. Since internal combustion engines are producing ever higher powers, the exhaust-gas temperatures are becoming ever higher. The exhaust manifolds and casings of turbochargers are exposed to temperatures of 900 to over 1000° C. The transformation temperature, i.e. the temperature at which one type of crystal in the alloy is transformed into another type of crystal, plays an important role at these high temperatures. At the transformation temperature, the volume changes and this volume change leads to irregular expansion characteristics on the part of the castings. The alloys which can be used must have transformation temperatures which are higher than the maximum temperature of use. Austenitic cast steel alloys or alloys with a high nickel content are also used for the abovementioned high use temperatures. Nickel is a relatively expensive raw material. The exhaust manifolds are often also formed from sheet-metal parts, in which case the poor sound insulation makes its presence adversely felt. These solutions are relatively complex to produce.

U.S. Pat. No. 5,236,660 discloses a cast iron alloy of the generic type. The alloy contains approximately 3.1% by weight of C, 4.6% by weight of Si, 1.9% by weight of Al, 1% by weight of Mo and if appropriate also admixtures of Co and Nb.

Working on the basis of this prior art, it is an object of the invention to provide a cast iron alloy which is made from elements which are as inexpensive as possible, the castings having as high a use temperature as possible.

SUMMARY OF THE INVENTION

The foregoing object is achieved by providing a cast iron alloy for cast iron products having a high thermal stability, wherein the alloy comprises containing, as nonferrous constituents, at least the elements C, Si, Mo, Al and, as admixtures, Ni, Mg and/or S, and the C content being less than 2.9% by weight and preferably 2.5 to 2.8% by weight.

DETAILED DESCRIPTION

In accordance with the present invention, the alloy should have the highest possible structure stability and be as resistant as possible to oxidation. The foregoing is achieved by providing a Si content of between 4.7 to 5.2% by weight and an Al content of between 0.5 to 0.9% by weight. Molybdenum is added in an amount of between 0.5 to 0.9% by weight.

The invention provides a cast iron alloy which has a transformation temperature of more than 950° C., has no disruptive expansion properties when used in conjunction with internal combustion engines and which can be produced as inexpensively as possible in a casting process. The graphite in the cast iron alloy may be spheroidal or vermicular. The amount of nickel added remains restricted to 0.1 to 1% by weight. Magnesium and silicon may be present in trace amounts of up to 0.05% by weight. It has proven particularly advantageous to add zirconium in the range from 0.1 to 0.4% by weight immediately before it is cast into its final shape. Zirconium has a favorable influence on the oxidation resistance and the mechanical strength. The zirconium may be added in the form of a prealloy.

EXAMPLE 1

An exhaust manifold for an internal combustion engine of a passenger car made from nodular cast iron with the following chemical composition in percent by weight: 2.6 C, 5.1 Si, 0.1 Ni, 0.6 Mo, 0.6 Al, 0.6 Zr, 0.04 Mg and less than 0.01 S has a ferritic microstructure. Measurements carried out in a dilatometer result in a longitudinal linear expansion coefficient of $16.10^{-16}$/K, which makes it possible to conclude that the transformation temperature is over 950° C. In a hot tensile test at a temperature of 300° C., the following mechanical strength values were determined: $Rp_{0.2}$=575 N/mm$^2$, Rm=600 N/mm$^2$ and A=0.4%.

EXAMPLE 2

An exhaust manifold for an internal combustion engine of a passenger car made from cast iron with vermicular graphite having the following chemical composition in percent by weight: 2.6 C, 5.1 Si, 1.0 Ni, 0.7 Mo, 0.6 Al, 0.3 Zr, 0.02 Mg and 0.02 S has a ferritic microstructure. Measurements carried out in a dilatometer result in a longitudinal linear expansion coefficient of $16.10^{-16}$/K, which makes it possible to conclude that the transformation temperature is over 950° C. In a hot tensile test at a temperature of 300° C., the following mechanical strength values were determined: Rm=545 N/mm$^2$ and A=0.1%.

If the temperature does not drop below 1460° C. during casting and if the elements Al and Zr are only added immediately prior to casting, for example as an Al—Zr prealloy, it is possible to produce ferritic cast iron products with a transformation temperature of over 950° C. The products produced in this way are distinguished by a very low change in volume as a function of the temperature, a good thermal shock resistance, good mechanical properties, a good resistance to oxidation and a low raw material price.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

The invention claimed is:

1. A cast iron alloy for a cast iron product characterized by high thermal stability, the alloy consisting essentially of, as nonferrous constituents, positive additions of C, Si, Mo, Al, Ni, Mg, Zr, wherein C is present in an amount of less than 2.5to 2.8% by weight, the Si content is 4.7 to 5.2% by weight, the Mo content is 0.5 to 0.9% by weight, the Al content is 0.5 to 0.9% by weight, the Ni content is 0.1 to 1.0% by weight, the Mg content is up to 0.05% by weight and wherein the Zr content is 0.1 to 0.4% by weight, wherein graphite in the as cast iron alloy comprises spheroidal graphite.

2. A cast iron alloy as claimed in claim 1, including S up to 0.05 wt. % max, and balance essentially Fe.

3. The cast iron alloy as claimed in claim 1, wherein the cast iron product comes into contact with exhaust gas from an internal combustion engine.

4. The cast iron alloy as claimed in claim 1, wherein the cast iron product is an exhaust manifold for receiving exhaust gases from an internal combustion engine.

5. A cast iron alloy according to claim 1, wherein S is less than 0.01.

6. In combination, an internal combustion engine and a cast iron product comprising an exhaust manifold for the internal combination engine, the cast exhaust manifold being contacted with exhaust gases from the internal combustion engine, the cast exhaust manifold comprises a cast iron alloy consisting essentially of, as nonferrous constituents, positive additions of C, Si, Mo, Al, Ni, Mg, Zr, wherein C is present in an amount of 2.5 to 2.8% by weight, the Si content is 4.7 to 5.2% by weight, the Mo content is 0.5 to 0.9% by weight, the Al content is 0.5 to 0.9% by weight, the Ni content is 0.1 to 1.0% by weight, the Mg content is up to 0.05% by weight and wherein the Zr content is 0.1 to 0.4% by weight, wherein graphite in the as cast iron alloy comprises spheroidal graphite, wherein the exhaust manifold is exposed to temperatures of greater than 900° C.

7. A cast iron alloy according to claim 6, wherein S is less than 0.01.

8. A process for producing the cast iron alloy as claimed in any one of claims 1, 4 and 6, wherein the Al and Zr are added as an Al—Zr prealloy immediately before the alloy melt is cast.

9. A process for producing the cast iron alloy as set forth in claim 8, wherein the temperature of the alloy melt is over 1460° C. immediately prior to casting.

* * * * *